10/15/85 OR 4,546,578

United States Patent [19]

Behrmann

[11] Patent Number: 4,546,578

[45] Date of Patent: Oct. 15, 1985

[54] TRANSPORTABLE HOLDING ASSEMBLY FOR RAPID ERECTION OF BUILDINGS

[76] Inventor: Georg Behrmann, Samstagstr. 2, Lauf, Fed. Rep. of Germany, 8560

[21] Appl. No.: 640,853

[22] Filed: Aug. 15, 1984

[30] Foreign Application Priority Data

Aug. 16, 1983 [DE] Fed. Rep. of Germany ..... 3329492

[51] Int. Cl.[4] ..... E04B 7/16; B60P 3/32

[52] U.S. Cl. ..... 52/67; 52/66; 52/79.5; 296/172; 296/173; 296/26; 296/27

[58] Field of Search ..... 52/64, 66, 67, 68, 69, 52/70, 71, 72, 79.5; 296/172, 173, 178, 179, 26, 27

[56] References Cited

U.S. PATENT DOCUMENTS

| | | | |
|---|---|---|---|
| 2,323,106 | 6/1943 | Whiteman | 52/66 |
| 2,384,659 | 9/1945 | Wait | 52/66 X |
| 3,168,343 | 2/1965 | Marcel | 296/26 X |
| 3,200,545 | 8/1965 | Bunge | 52/67 |
| 3,300,914 | 1/1967 | Stewart et al. | 52/67 |
| 3,531,151 | 9/1970 | Branfield | 296/173 |
| 3,556,581 | 1/1971 | DaSilva | 296/173 |
| 3,596,416 | 8/1971 | Hojka | 296/173 X |
| 3,838,880 | 10/1974 | Lefebvre | 296/173 |
| 4,114,942 | 9/1978 | Greiner | 52/66 X |
| 4,270,319 | 6/1981 | Spasojevic | 52/67 X |

FOREIGN PATENT DOCUMENTS

| | | | |
|---|---|---|---|
| 858592 | 11/1940 | France | 296/26 |
| 109677 | 8/1966 | Norway | 52/69 |
| 378694 | 7/1964 | Switzerland | 269/26 |
| 1280222 | 7/1972 | United Kingdom | 296/27 |

*Primary Examiner*—Donald G. Kelly
*Assistant Examiner*—Richard E. Chilcot, Jr.
*Attorney, Agent, or Firm*—Holman & Stern

[57] ABSTRACT

A container assembly for rapid erection of portable buildings meets the following requirements: it is transportable by a single truck tractor, has dimensions which are customary and permissible for highway transport, and may be quickly erected on-site by simple means, whereby its floor space in the use mode is multiplied over that in the transporting mode and comprises two side containers swingably linked to a central container on the two longitudinal sides of the central container, whereby said side containers swing inwardly to fit one into the other and over the central container. When the assembly is in the swung-in transporting and storing position the available floor space is reduced to approximately one-third of that in the swung-out use position. The container assembly is particularly advantageous for use as a mobile hospital.

20 Claims, 13 Drawing Figures

W
V
2
2d
3
3f
3e
4
4c
4d
4e
4f
5
6
7
8
9
10
11
12
14
15
16
17
18
19
20
21
22
23

TRANSPORTABLE HOLDING ASSEMBLY FOR RAPID ERECTION OF BUILDINGS

BACKGROUND OF THE INVENTION

1. Field of the Invention

The invention relates to a transportable container assembly for rapid erection of buildings. An example of a building which might employ such a container assembly is a mobile hospital, which may be set up temporarily during an epidemic or catastrophe, or in a battle zone, for the purpose of treating sick or injured individuals in the impacted region, and from there may be moved quickly to a new location to be re-erected for service while the sick and injured at the new location are treated, and so forth.

2. Description of the Prior Art

Such buildings are frequently comprised of containers in which the necessary fixtures are pre-installed, to the extent such pre-installation is possible. Since these containers are transported on open truck-beds, the dimensions of each such container must correspond to customary and permissible dimensions employed in highway transport. The width limitations thus imposed are inadequate for most practical-use situations, in that they result in limitation of the interior width of the building to about 2.40 m.

As a result of this width limitation, a combination of several containers must be constructed in order to have a sufficiently wide floor surface in the building. In this connection, two solutions to the problems are employed in practice. Several containers are erected independently side-by-side, and after complete or partial removal of their mutually-facing side walls the containers are joined together on their longitudinal sides. Alternatively, several containers which fit into each other are employed, which can be withdrawn telescopically in the horizontal direction perpendicular to their longitudinal dimension. Both of these solutions have their drawbacks.

Under the first-mentioned solution, three containers are needed for a building of width, e.g., 7.20 m. This requires that either three tractor vehicles be available or that one tractor make three trips to the erection point (if only one tractor is available). This is costly, and in the latter case is also time-consuming. Special hoisting devices and extensive other equipment are needed for erecting the containers and joining them together. The time required for the erecting and joining is also excessive.

Under the second-mentioned solution it is practically impossible to achieve a threefold increase in the container floor space, between the inner containers in the telescoped set are necessarily narrower than the outer containers. In the telescopically extended position there is an annoying step at the boundary between individual containers, in particular on the floor. Further, the mechanical or hydraulic mechanisms required for telescopically drawing out the inner containers, which containers may be up to 12 m long and 2.5 m high, are quite expensive. Moreover, the necessary equipment and fixtures may be installed only in the innermost container. The equipment to be used in the other containers must be shipped separately and may be installed only after the telescopically extended position has been attained.

BRIEF SUMMARY OF THE INVENTION

The underlying problem giving rise to the invention is to devise a container (or module) assembly for rapid erection of buildings, which assembly requires only one truck tractor for transport and which has dimensions which are customary and permissible in highway transport, and further which can be erected on-site by simple means and substantially faster than known container assemblies, by multiplying its horizontal cross-section which pertains in its shipping configuration, without such container assembly having the drawbacks of known container assemblies.

This problem is solved according to the invention by the combination of the following features:

(a) The container assembly is comprised of a middle container, of a generally parallelepiped shape, and two side containers each of which extends along one of the two longitudinal sides of the middle container;

(b) Each of the two side containers is pivotably mounted to the middle container so as to pivot about an axis which passes approximately through the respective lower adjacent corners of the end walls of the middle container;

(c) The pivoting excursion of the two side containers between the two extreme positions of each is 90°, these positions being the swung-out position in which the building is used, and the swung-in position in which it is transported or stored;

(d) The internal length of each of the two side containers is greater than that of the middle container, the difference being at least equal to the sum of the thicknesses of the two end walls of the middle container;

(e) The two side containers have different lengths and widths; namely, the internal length of the second exceeds that of the first by at least the sum of the thicknesses of the two end walls of the first, and the internal width of the second exceeds that of the first by at least the combined thicknesses of the longitudinal side wall and roof of the first; and (f) The roofs of the two side containers are associated with them in such a way as to be removable from the installed roof position.

On the basis of these features the two side containers are pivotable above the middle container, whereby in the swung-together transporting and storing position, in which position the longitudinal side of the first side container is parallel to the roof of the middle container and the longitudinal side of the second side container is parallel to that of the first, the overall container assembly has dimensions which are customary and permissible in highway transport, and said assembly also requires only one truck tractor. In the swung-out position in which the structure is used, which position can be attained rapidly and in simple manner, the container assembly is at least three times as wide, and the floor of the middle container passes (merges) into those of the two side containers with no annoying steps. The required fixtures and equipment may be completely installed in the middle container and also to some extent (at least partially) in the two side containers. ("Partial installation" might be, e.g., installation in the form of downwardly swingable separating walls, sanitary facilities, electrical lines, etc.). The problems with the side walls of the middle container, which problems occur in the case of the known type of container assembly with containers which fit into one another in telescoping fashion, are avoided.

It should be remarked concerning the above feature (e) of the invention that side containers of equal length may be employed, which are then mutually shifted by a distance equal to the thickness of one end side, said shift being in the direction of their longitudinal axis. However, this arrangement has the drawback that the hoisting apparatus which performs the swinging open of the side containers may engage only one of the end sides, and accordingly support means must be provided in the region of the other end side, in the case of long containers.

For support of the side containers in their swung-in (transporting and storing) position, according to a first embodiment of the invention load-bearing means are provided at the chassis ends of the middle container, whereby a side edge of each of the end walls of each of the side containers rests against said load-bearing means. In a second embodiment of the invention, the said support comes from crossbeams which are provided on the roof of the middle container and against which the longitudinal side of a side container rests. Alternately or additionally, according to this second embodiment, external brackets are provided on the lower longitudinal side of the first side container (i.e., the longitudinal side which is lower in the transporting and storing position), whereby the longitudinal side of the second side container rests against said brackets.

In order to provide for removability of the roofs from the roof position on the containers so as to be able to swing the side containers upward and inward, according to another essential feature of the invention the roofs of the two side containers are both swingably mounted at the upper edges of the respective longitudinal sides of the middle container, whereby the swing axis of the first roof is higher than that of the second said roof by a distance corresponding to at least the thickness of the second roof. With this embodiment the roofs of the two side containers are swung inward when converting to the transporting and storing position, so that they come into a position above and parallel to the roof of the middle container. Under this arrangement, means must be provided at the end borders of said roofs to compensate for the gap in length. An example of such means might be roof extension strips or end wall shoulder brackets.

On the other hand it may be advantageous for the roofs of the two side containers to be held parallel to the longitudinal sides of said containers, in the transporting or storing position. Under this arrangement, the roofs may be raisable to convert to the use position, in particular, they each may be hoistable to the point of the upper edge of the respective longitudinal side, whereby following such hoisting they may be downwardly swingable around a respective pivot point established on the upper edge of the respective longitudinal side. With this embodiment it is advantageous to provide a pair of masts with pulleys, one in the vicinity of each of the two said longitudinal sides, to facilitate the hoisting of the roofs parallel to the longitudinal sides of the side containers.

It is further advantageous to provide sealing means, e.g., elastic gaskets, and/or locking or interlocking elements in the edge regions of the longitudinal and end walls of the side containers, to ensure sealed joints between the side containers and the middle container, and between the side container roofs and the respective side containers.

In a further refinement of the invention, hoisting devices are provided for swinging the side containers up and over onto the chassis of the middle container, which devices preferably are in the form of gripper hoists, wherewith each gripper hoist has associated with it a pulley which is disposed laterally to it in a plane parallel to the end face of the side container and is vertically adjustable (as to the altitude of its spin axis). These hoists enable rapid and simple on-site conversion of the container assembly from the transporting and storing position into the building use position, or from the use position into the transporting and storing position. It is not necessary to bring along a crane. With known arrangements, the need to do so is often very time-consuming when difficult terrain is involved, and may even be impossible.

One may substantially facilitate the swinging up and over of the two side containers by choosing the position of the pulleys and the swing axes and centers of gravity of the side containers such that when the center of gravity of a side container is located over its swing axis, i.e. at some point within the swing excursion of the side container, the distance between the pulley and the attachment point of the cable where said cable attaches to the side container is at a minimum. What is achieved by means of this inventive feature is that when, during the swing excursion of the side container, the point is reached at which the center of gravity of the side container is disposed directly over the swing axis of said container, and this point is passed through in the direction generally opposite to the tension direction and direction of movement of the cable, the movement direction of the cable is reversed (from toward the pulley to away from the pulley), with the container thus momentarily "falling into the cable", and the path of fall is the minimum possible.

BRIEF DESCRIPTION OF THE DRAWINGS

The invention will now be described in detail with reference to the accompanying drawings of an exemplary embodiment wherein.

DETAILED DESCRIPTION

Figure 1:
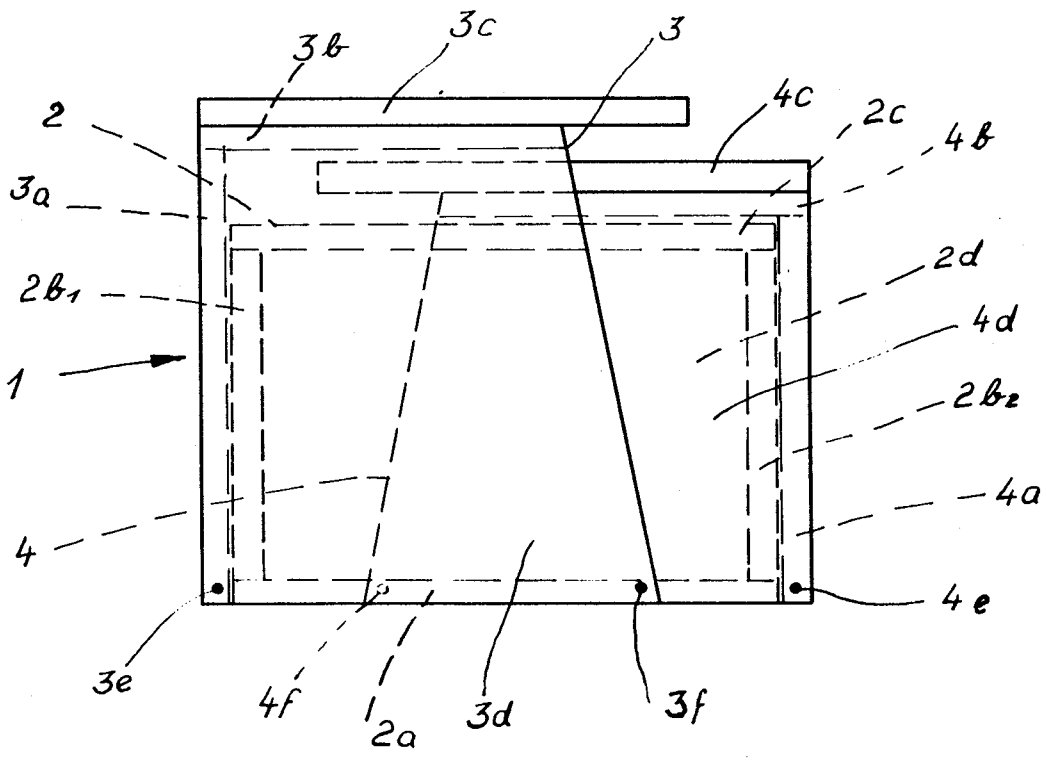
FIGS. 1 to 3 are schematic end views of the container assembly in various positions.

The transporting and storing position of the container assembly 1 is shown in an end view of FIG. 1. The assembly is comprised of a box-shaped middle container 2 with floor 2*a*, side walls $2b_1$ and $2b_2$ (which comprise the longitudinal sides of the middle container, roof 2*c*, and end side 2*d*; a left side container 3 with floor 3*a*, side wall (longitudinal side) 3*b*, roof 3*c*, and end side 3*d*; and a right side container 4 with floor 4*a*, side wall (longitudinal side) 4*b*, roof 4*c*, and end side 4*d*. The axes 3*e* and 4*e* are the swing axes of the respective side containers 3 and 4, and points 3*f* and 4*f* are respective attachment points.

In the transporting and storing position shown, the two side containers 3 and 4 are in the swung-in position wherein their floors 3*a* and 4*a*, respectively, rest against, or are positioned against, the longitudinal sides $2b_1$ and $2b_2$, respectively of the middle container 2; and their longitudinal sides 3*b* and 4*b*, respectively, against the exterior of which sides their respective roofs 3*c* and 4*c* are held, are supported against the roof 2*c* of the middle container 2. The end side 2*d* of the middle container 2 is concealed by the end sides 3*d* and 4*d* of the respective side containers 3 and 4.

It may be seen from FIG. 1 that the width of the left side container 3 is greater than that of the right side container 4. This is necessary so that these containers can swing together, one into the other, in such a way that their longitudinal sides 3*b* and 4*b* with the respective roofs 3*c* and 4*c* will be superimposed one above the other on top of the roof 2*c* in the transporting and storing position shown. It may also be seen that the two side containers 3 and 4 have different lengths. Container 3 is longer by a distance at least equal to the sum of the thicknesses of the two end sides 3*d* of container 3.

Figure 2:
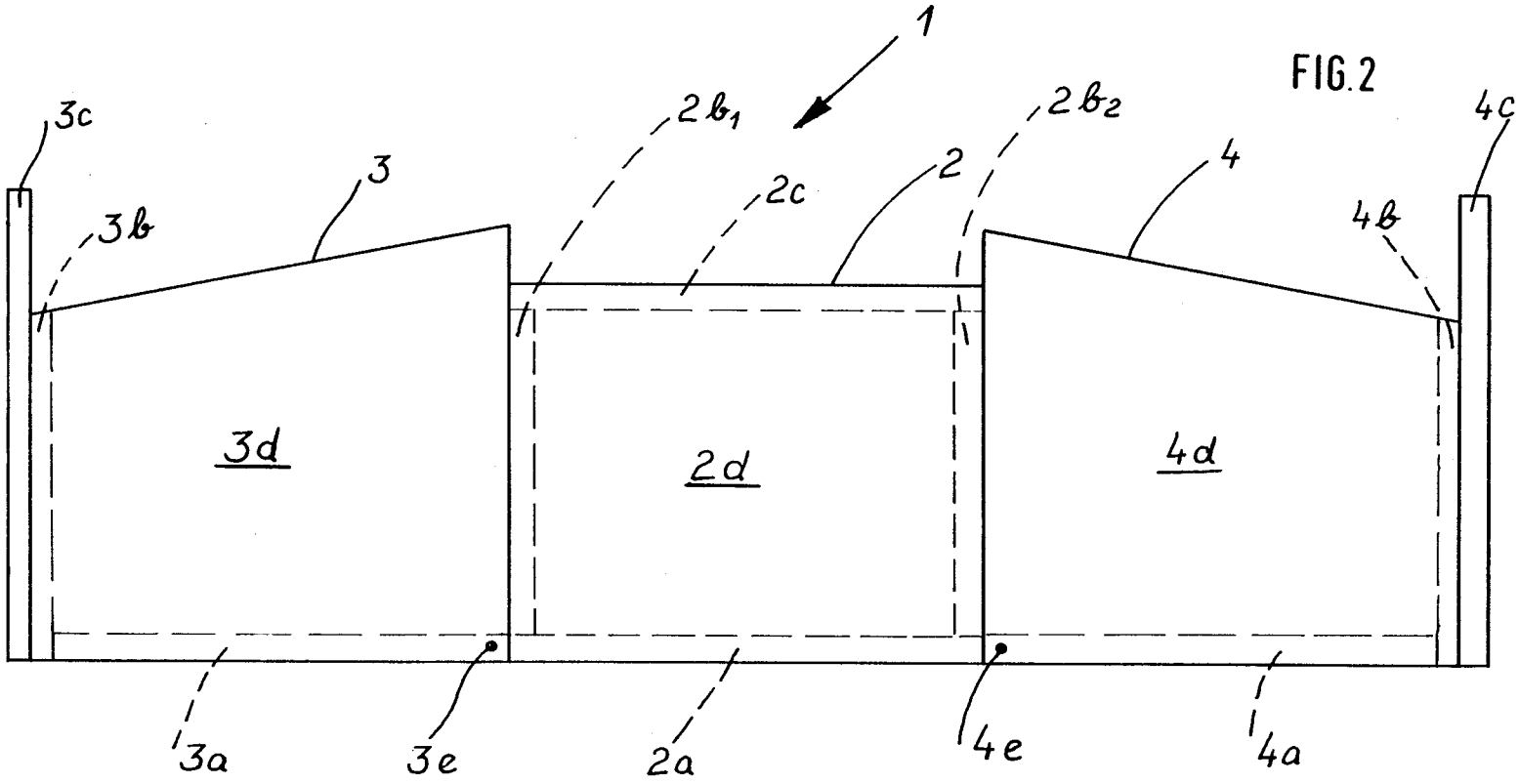
Figure 3:
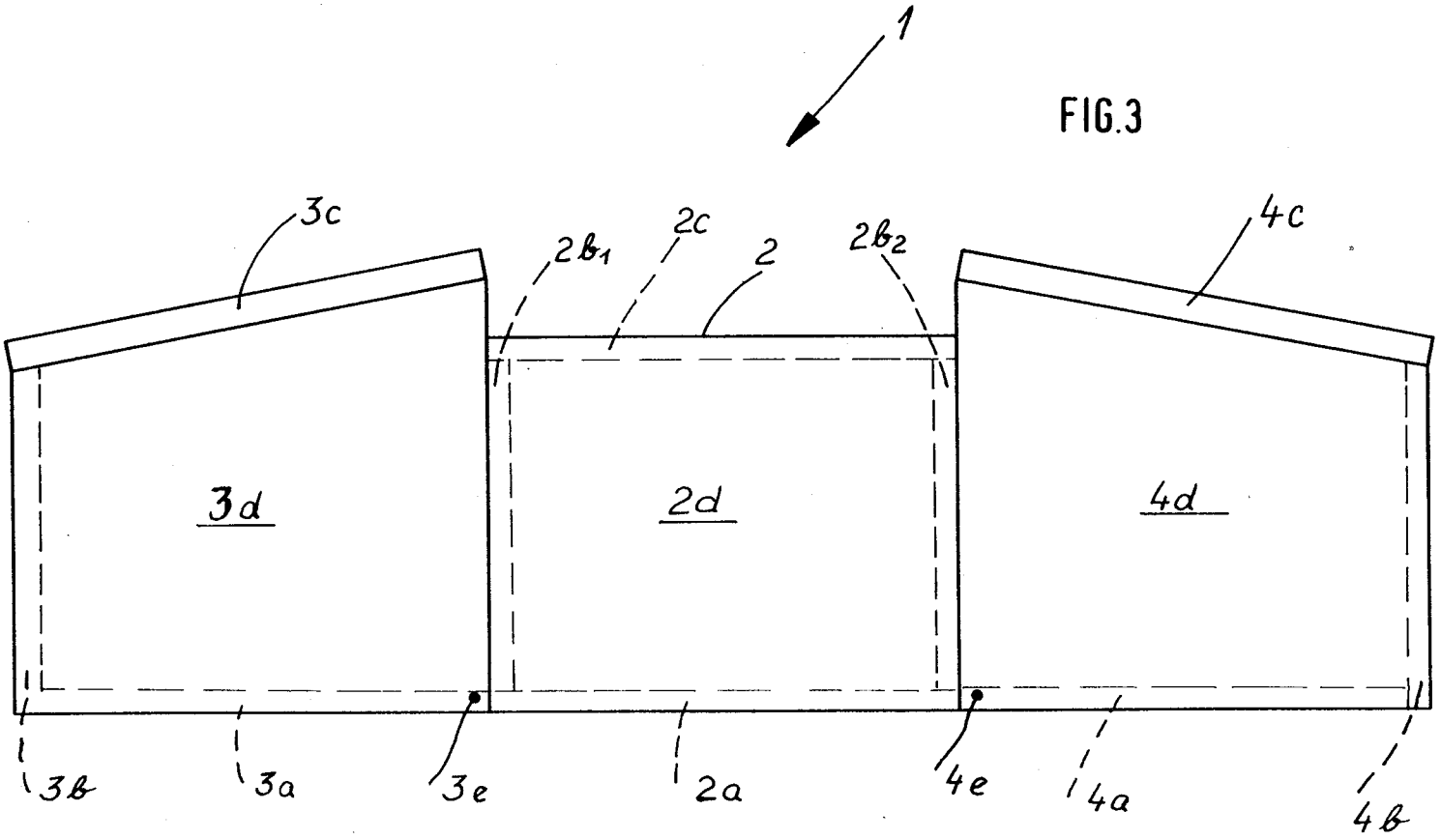

FIG. 2 shows an intermediate position of container assembly 1 wherein the two side containers have been swung outwardly by 90° from their position of FIG. 1. In this intermediate position, the roofs 3*c* and 4*c*, respectively, of the two side containers 3 and 4 remain in their transporting and storing disposition relative to containers 3 and 4; they assume their operating position only later, in the use position of the container assembly 1 shown in FIG. 3.

Figure 4:
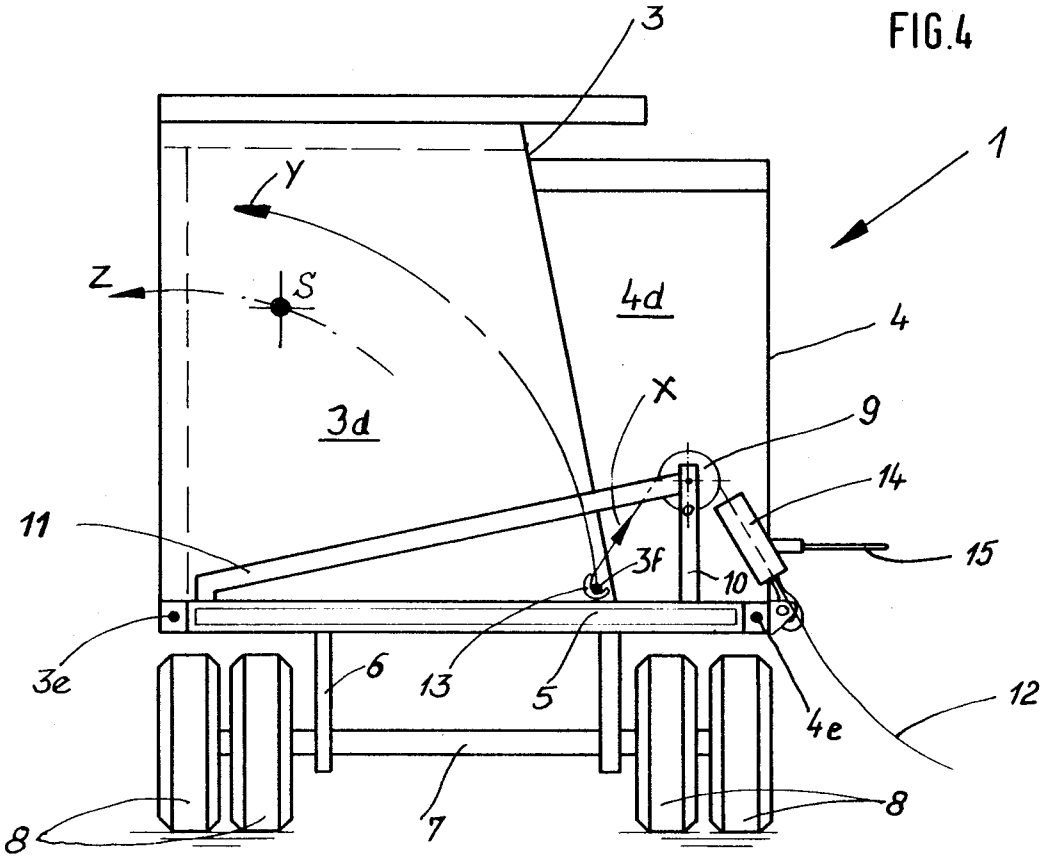
FIGS. 4 to 6 are schematic end views showing various positions during the swinging-out of the left side container.

FIG. 4 also shows the container assembly 1 in the transporting and storing position, but here the chassis 5 is shown, furnished with chassis frame 6, axle 7, and wheels 8. A pulley 9 is disposed ahead of the end sides 3*d* and 4*d* on the chassis 5, with the working plane of pulley 9 being parallel to the end sides 3*d* and 4*d*. The pulley 9 is rotatably mounted on a vertical upright 10, and laterally buttressed by a strut 11 disposed in said working plane. The height of pulley 9 is adjustable with respect to the floor. The subassembly comprised of the pulley 9, the upright 10, and the strut 11 may alternatively be disposed in the opposite (left side of Figure) position (see FIGS. 7 to 9). A cable or the like 12 passes over the pulley 9 and is attached to the attachment point 3*f* of the left side container 3 by means of a hook 13. The cable also passes through a gripper hoist 14 having operating lever 15.

In this arrangement, the positions of the pulley 9, the swing axis 3*e*, and the center of gravity S of the left side container 3 are chosen such that the included angle between the floor 2*a* of the middle container 2 and the line joining the swing axis 3*e* and the center of the pulley 9 is approximately equal to the included angle between the floor 3*a* of the side container 3 and line joining the swing axis 3*e* and the center of gravity S of container 3, which latter angle should be kept as small as possible by appropriate structural design measures.

Figure 5:
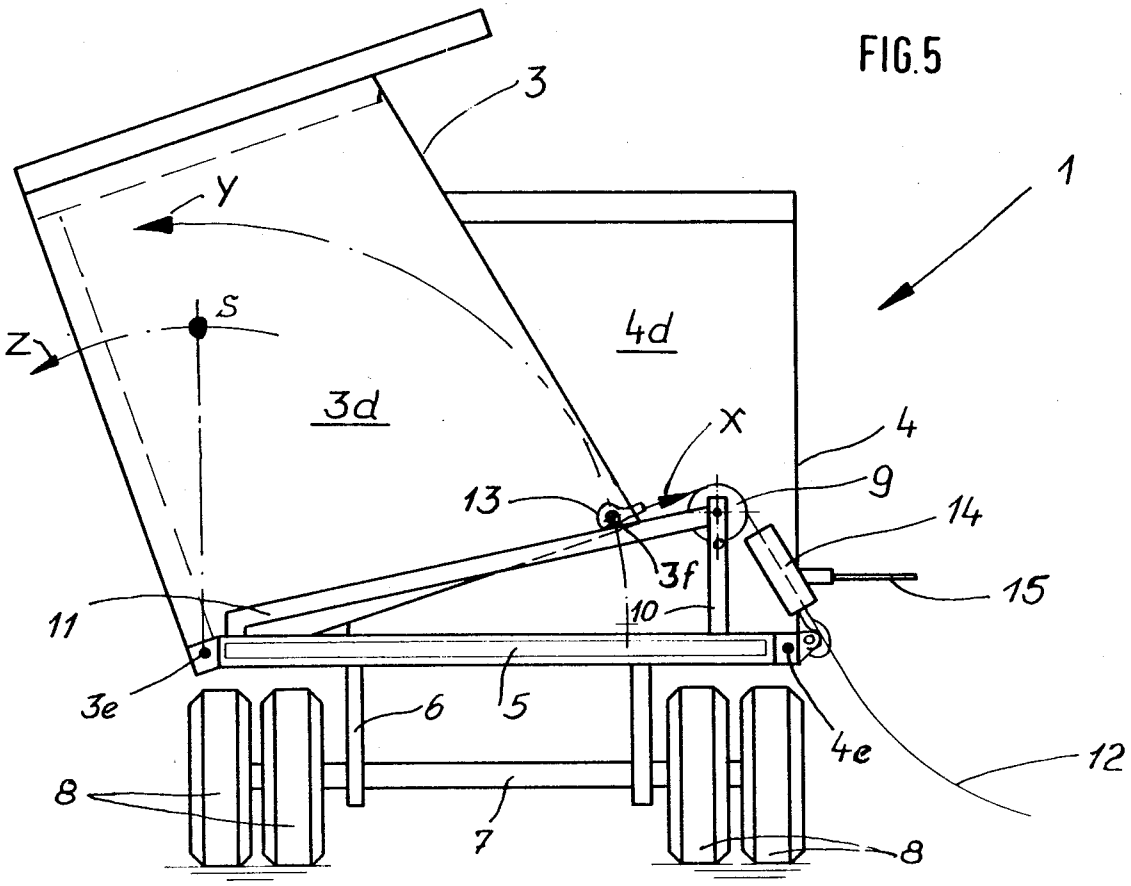
Figure 6:
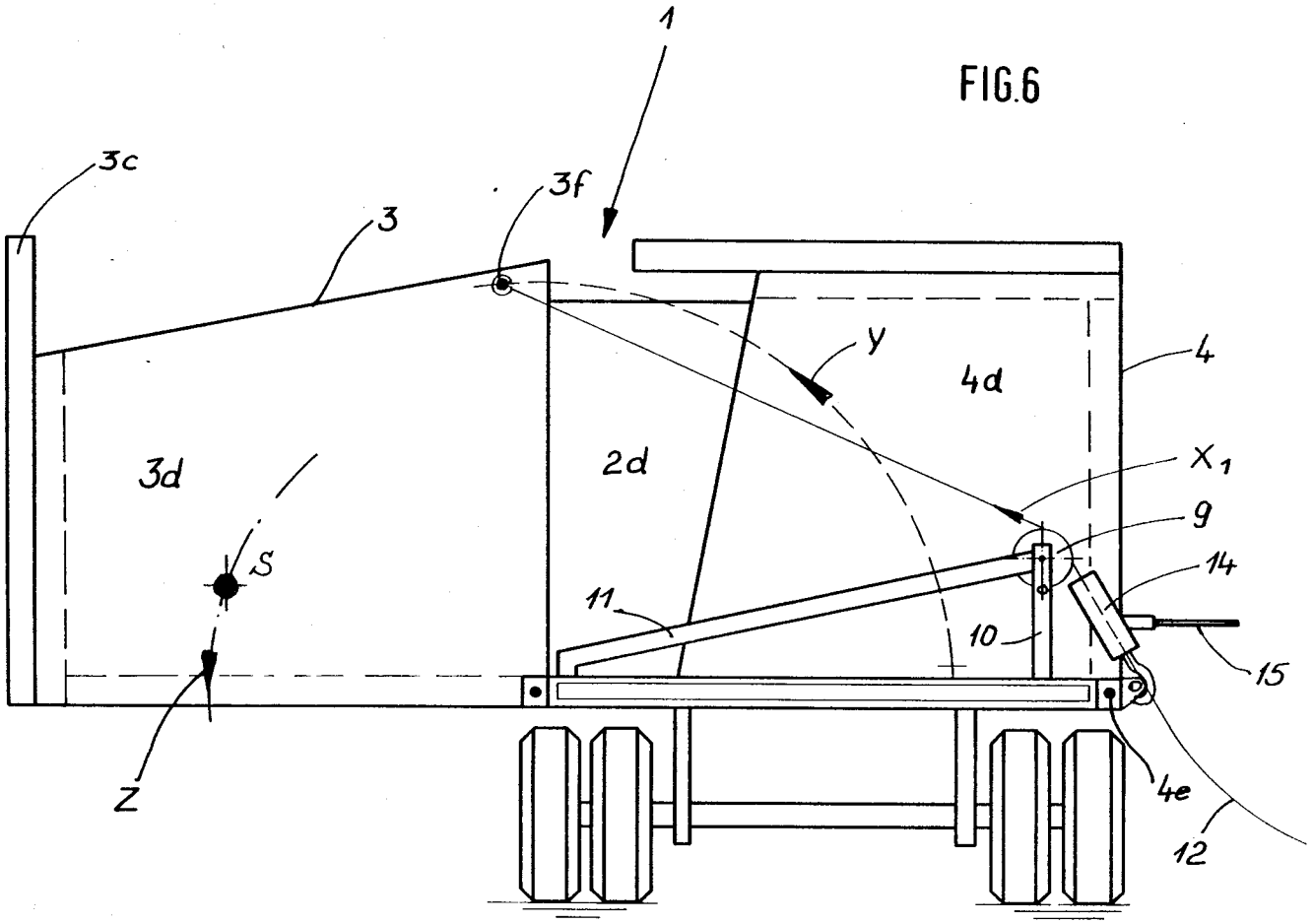

If the gripper hoist 14 is actuated so as to move (pull) the cable 12 in the direction of the arrow X, the side container 3 will be swung upward, with the attachment point 3*f* describing a circular arc in the direction of arrow Z. Hoist 14 is operated until the theoretically illustrated position of FIG. 5 is reached, wherein the center of gravity S of the side container 3 is vertically precisely above the swing axis 3*e* of container 3, while the cable 12 is still moving. As soon as the center of gravity S of container 3 swings farther about the swing axis 3*e*, as a result of the aforesaid movement of the cable, then the cable 12 changes movement direction (being now played out instead of drawn in) to that of arrow $X_1$ (FIG. 6), until the side container 3 reaches its fully swung-out position (shown in FIG. 6).

Figure 7:
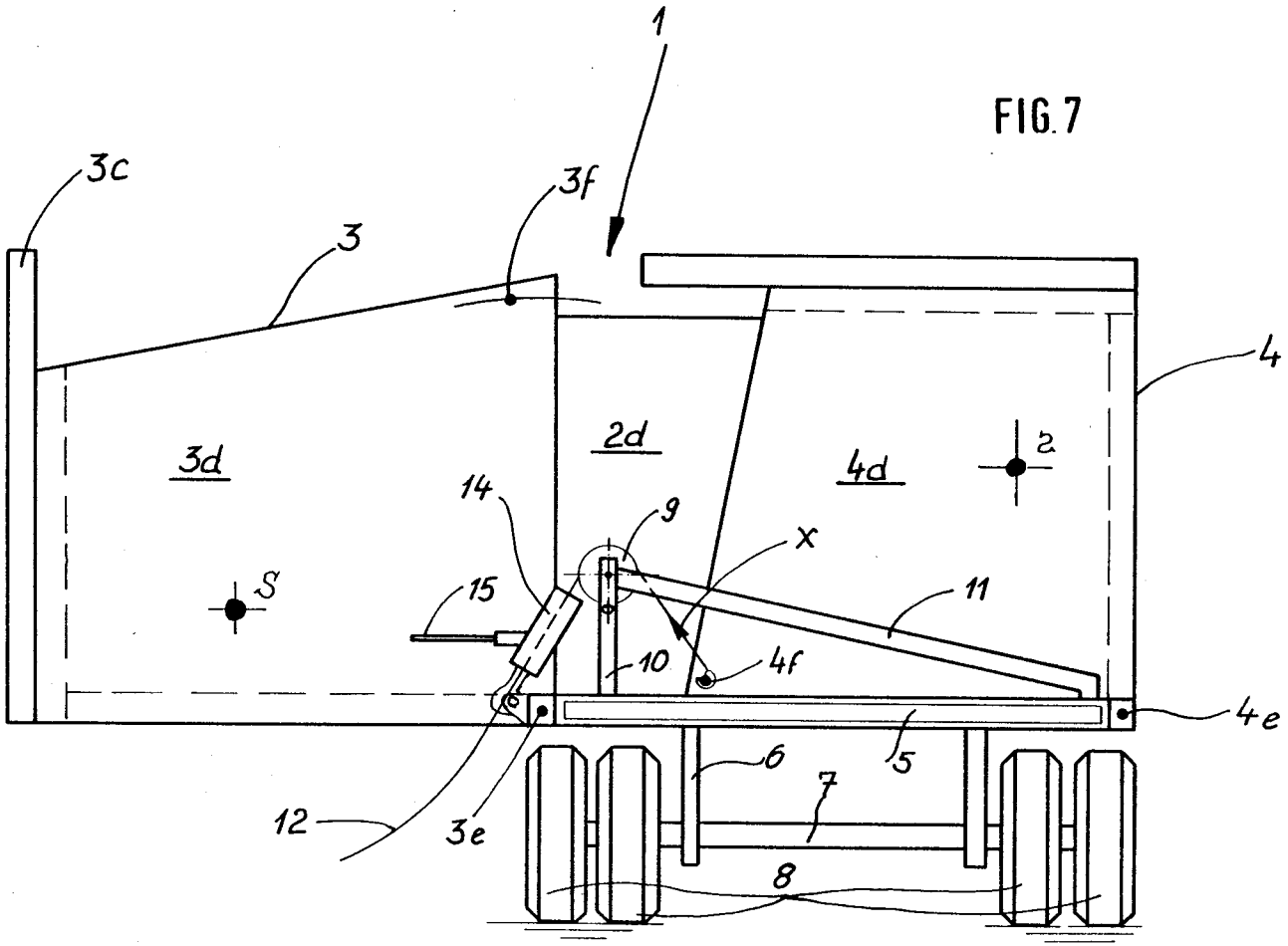
FIGS. 7 to 9 are schematic end views showing various positions during the swinging-out of the right side container.
Figure 8:
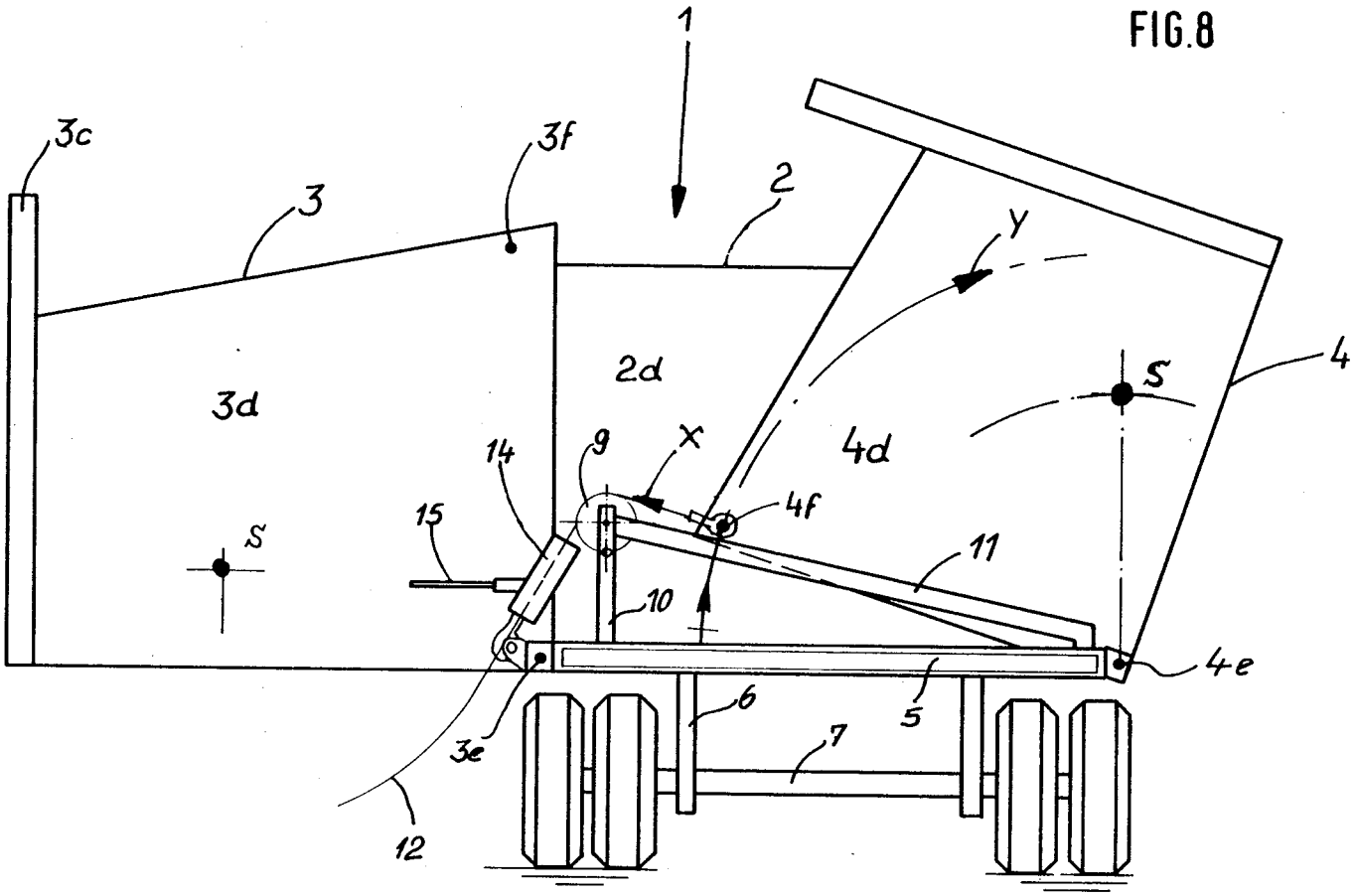
Figure 9:
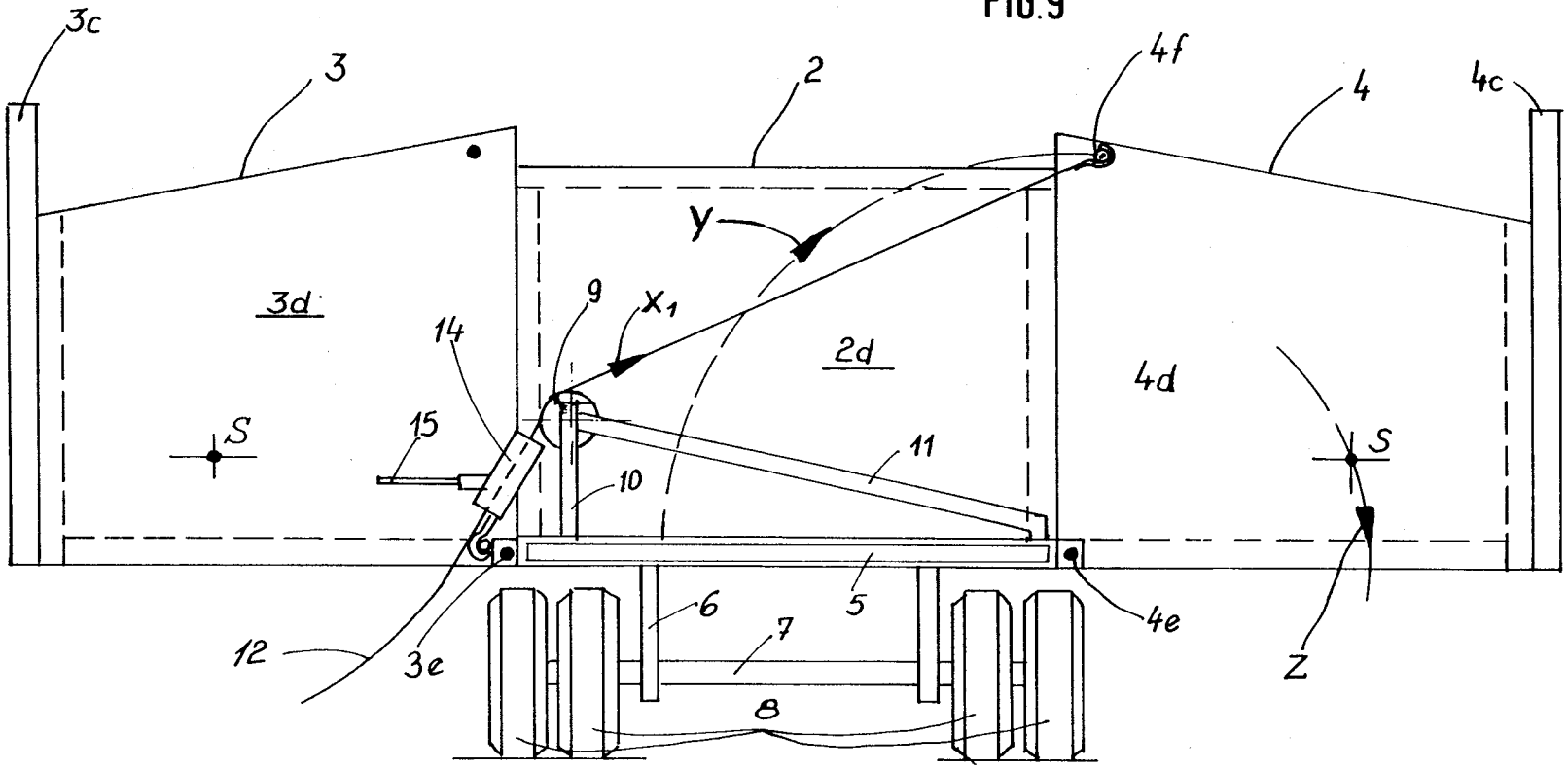

FIGS. 7 to 9 illustrate the same swinging-out process for the right side container 4. The only difference between this situation and that of FIGS. 4 to 6 lies in the opposite (left side) disposition of the subassembly comprised of the pulley 9, the upright 10, and the strut 11.

It is necessary that the height of the pulley 9 be adjustable because in the swinging-in of the side container 3, or, into the transporting and storing position, the center of gravity of the side container must be moved up over the swing axis 3*e*, or 4*e*, by pulling on the cable 12.

Figures 10A, 10B, 10C:
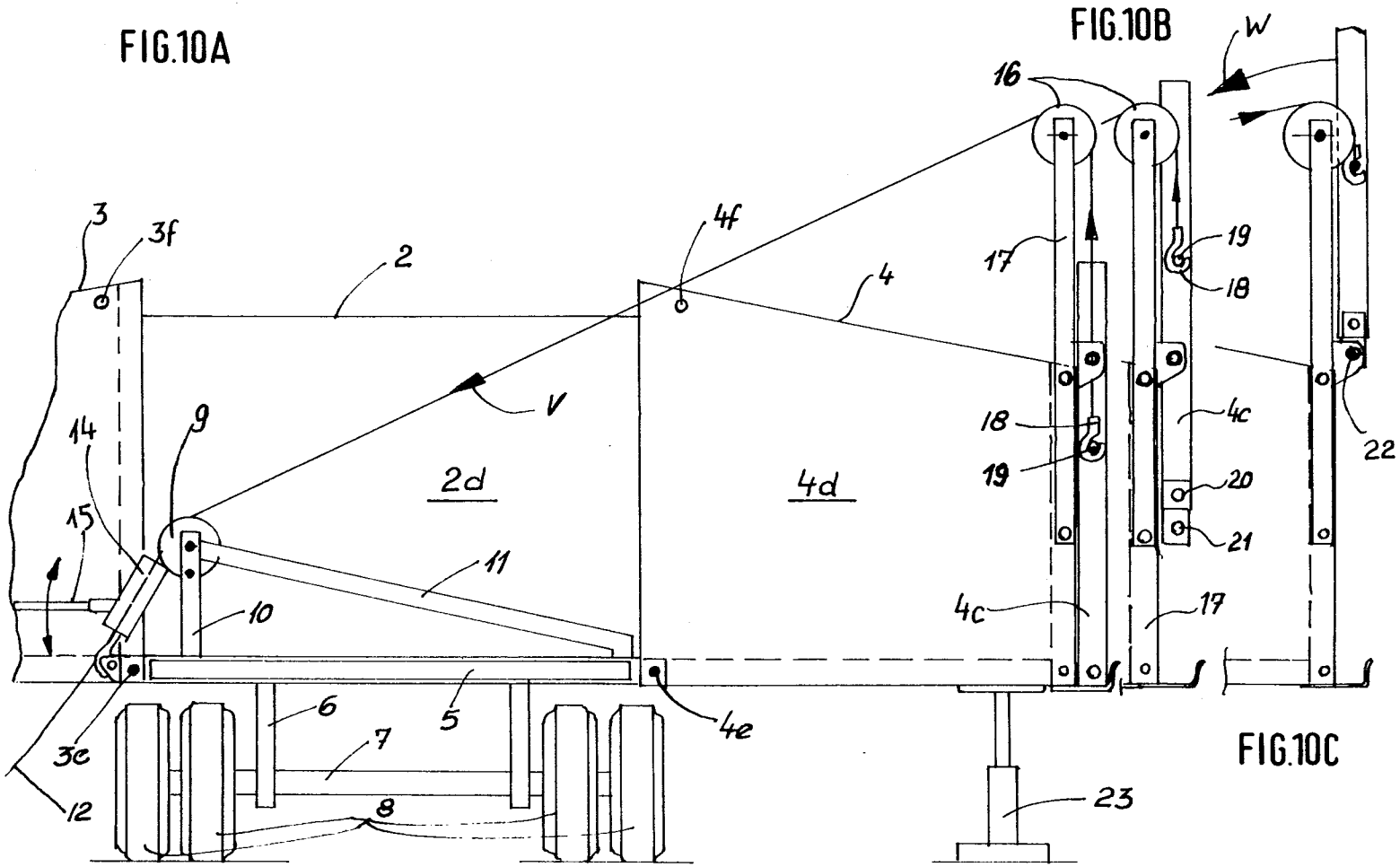
FIGS. 10*a* to 10*c* are schematic end views which show different positions during the setting up of the roof of the right side container.

FIGS. 10A to 10C show stages in the setting up of the roof 4*c* into its service position on the side container 4, for the embodiment wherein the roof 4*c* is maintained parallel to the longitudinal side 4*b* of the side container 4 when the assembly is in the transporting and storing position. The cable 12 is passed over a pulley 16 on a post 17 and is attached to a rod 19 on the roof 4*c* by means of a hook 18. The cable is pulled (moved) in the direction of arrow V by means of the gripper hoist 14 with the aid of the subassembly comprised of pulley 9, upright 10, and strut 11, which gripper hoist and subassembly are disposed identically as during the swinging-out of the side container 4. The pulling of the cable 12 in this manner results in the vertical hoisting of the roof 4*c*. Then a lug 21 is attached to a boss 20 disposed on the lower end of roof 4*c* (FIG. 10B), and the roof is hoisted to its highest position (FIG. 10C), in which position it is pivotably mounted on a pivot 22 attached to the post 17, said mounting being via lug 21. The cable 12 is then played out gradually, whereby the roof 4*c* swings downward in the direction of arrow W and assumes its service position.

Figure 11:
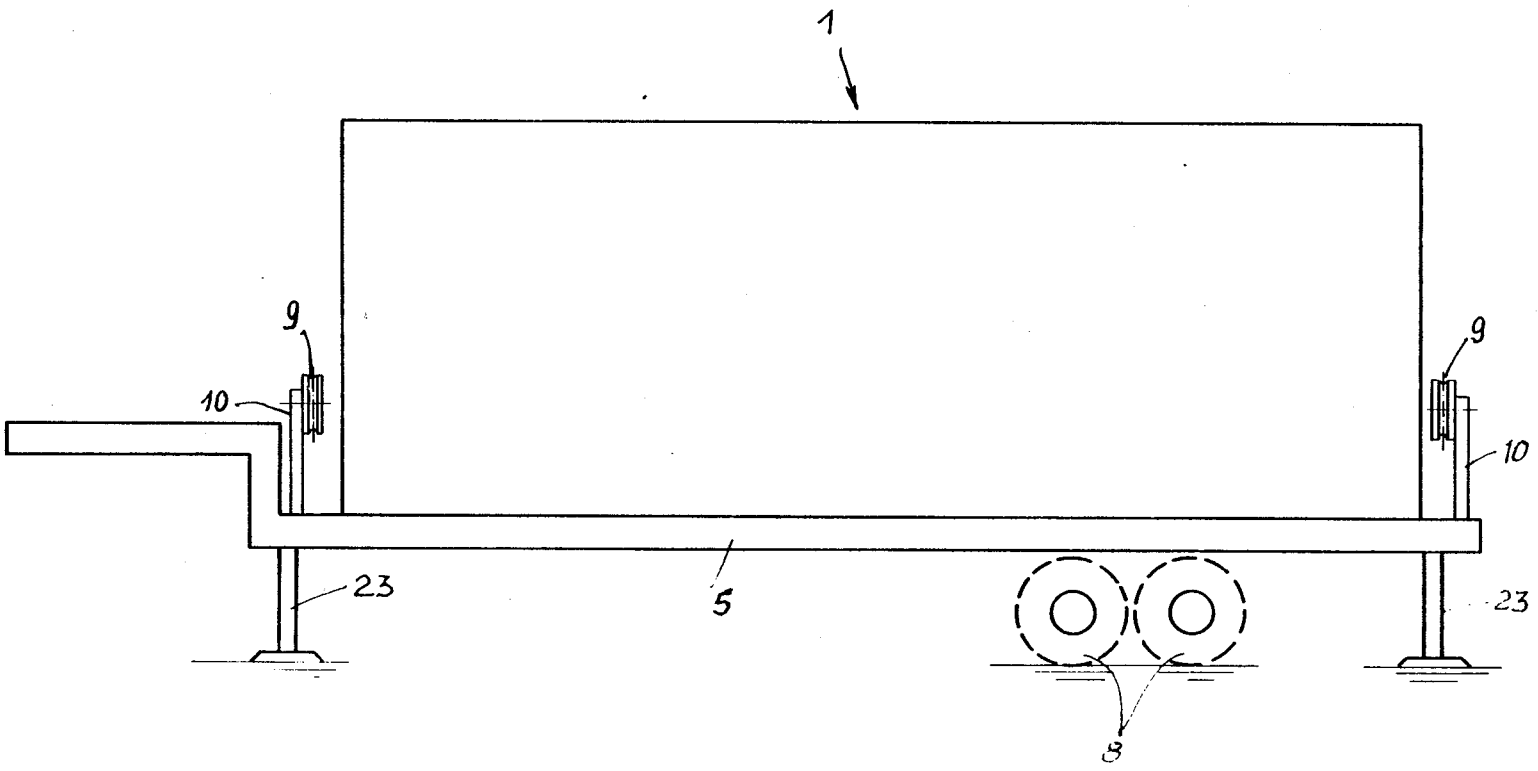
FIG. 11 is a schematic side elevational view of the container assembly in the transporting and storing position.

FIG. 11 shows the container assembly 1 in its transporting and storing position (truck tractor not shown) wherein it is supported on the ground by supports 23. Such a support 23 may also be seen in FIG. 10A, where it is supporting the right side container 4 on the ground when container 4 is in the use position.

I claim:

1. A transportable container assembly for rapid erection of portable buildings comprising:

(a) a middle container having a generally box-like shape with longitudinal side walls, end walls, a floor and a roof, and two side containers each extending along one of the longitudinal sides of the middle container and having one longitudinal side wall, two end walls, a floor and a roof;

(b) means to pivotably connect each of the two side containers to the middle container so that each side container is pivotably movable through approximately 90°, between a swung-in transporting and storing position and a swung-out use position, about a pivot axis which passes approximately through the respective lower adjacent corners of the end walls of the middle and side containers;

(c) the first side container having an internal length greater than that of the middle container by an amount at least equal to the sum of the thicknesses of the two end-walls of said middle container;

(d) the second side container having an internal length greater than that of said first side container by an amount at least equal to the sum of the thicknesses of the two end walls of said first container;

(e) the internal width of the first side container being at least slightly greater than the height of said middle container, and the internal width of said second side container being greater than that of said first side container by an amount at least approximately equal to the sum of the thicknesses of the longitudinal side wall and roof of the first side container; and (f) means for moving the roofs of the two respective side containers between a transporting and storing position parallel and adjacent to the respective longitudinal side walls and an installed roof position for use.

2. A container assembly as claimed in claim 1 and further comprising: load-bearing means provided at the ends of the chassis of the middle container for supporting the side containers in the swung-in position thereof so that a side edge of each of the end walls of each of the side containers rests against said load-bearing means.

3. A container assembly as claimed in claim 1 and further comprising: cross beams provided on the roof of the middle container for supporting the side containers in the swung-in position of said containers, so that the longitudinal side of said first side container rests against said cross beams.

4. A container assembly as claimed in claim 1 and further comprising: means for pivotally mounting the roofs of the two side containers respectively at the upper edges of the respective longitudinal sides of the middle container so that the pivot axis of the roof of said second side container is higher from the floor than that of the roof of said first container by a distance corresponding to at least the thickness of the first roof.

5. A container assembly as claimed in claim 1 wherein said means for moving the roofs of the two side containers comprises, hoisting means operatively connected to said roofs, respectively, to hoist said roofs to convert them to the use position, so that after being fully-hoisted to the upper edge of a respective longitudinal side wall, said roofs are downwardly swingable around a respective pivot point on the upper edge of the respective longitudinal side wall.

6. A container assembly as claimed in claim 5 wherein said hoisting means comprises, a pair of masts each of which is disposed adjacent each respective longitudinal side wall of said side containers, and a pulley mounted on each mast to facilitate the hoisting of the roofs parallel to the longitudinal sides.

7. A container assembly as claimed in claim 1 and further comprising, sealing means and locking elements provided in the edge regions of the longitudinal side- and end-walls of the side containers respectively, to ensure sealed joints between the side containers and the middle container, and between the side container roofs and the respective side containers in the position for use.

8. A container assembly as claimed in claim 1 and further comprising hoisting devices operatively connected to said side containers, respectively, for swinging the side containers about said pivot axes between said swung-in and swung-out positions.

9. A container assembly as claimed in claim 8 wherein said hoisting devices comprise gripper hoists.

10. A container assembly as claimed in claim 9 and further comprising a pulley and a cable operatively associated with each gripper hoist disposed laterally with respect to each hoist in a plane parallel to the end wall of the middle container, said pulley being vertically adjustable to vary its axis of rotation, and attachment means for each cable on each side container.

11. A container assembly as claimed in claim 8 wherein said pulleys and pivot axes and the centers of gravity of the side containers, respectively, are positioned with respect to each other so that when the center of gravity of a side container is positioned over its respective pivot axis the distance between the pulley and the respective attachment neans where said cable attaches to the side container is as short as possible.

12. A container assembly as claimed in claim 3 and further comprising: means for pivotally mounting the roofs of the two side containers respectively at the upper edges of the respective longitudinal sides of the middle container so that the pivot axis of the roof of said second side container is higher from the floor than that of the roof of said first container by a distance corresponding to at least the thickness of the first roof.

13. A container assembly as claimed in claim 2 wherein said means for moving the roofs of the two side containers comprises, hoisting means operatively connected to said roofs, respectively, to hoist said roofs to convert them to the use position, so that after being fully-hoisted to the upper edge of a respective longitudinal side wall, said roofs are downwardly swingable around a respective pivot point on the upper edge of the respective longitudinal side wall.

14. A container assembly as claimed in claim 3 wherein said means for moving the roofs of the two side containers comprises, hoisting means operatively connected to said roofs, respectively, to hoist said roofs to convert them to the use position, so that after being fully-hoisted to the upper edge of a respective longitudinal side wall, said roofs are downwardly swingable around a respective pivot point on the upper edge of the respective longitudinal side wall.

15. A container assembly as claimed in claim 2 and further comprising, sealing means and locking elements provided in the edge regions of the longitudinal side- and end-walls of the side containers respectively, to ensure sealed joints between the side containers and the middle container, and between the side container roofs and the respective side containers in the position for use.

16. A container assembly as claimed in claim 6 and further comprising, sealing means and locking elements provided in the edge regions of the longitudinal side- and end-walls of the side containers respectively, to ensure sealed joints between the side container roofs and the respective side containers in the position for use.

17. The container assembly as claimed in claim 6 and further comprising hoisting devices operatively connected to said side containers, respectively, for swinging the side containers about said pivot axes between said swung-in and swung-out positions.

18. A container assembly as claimed in claim 8 wherein said pulleys and pivot axes and the centers of gravity of the side containers, respectively, are positioned with respect to each other so that when the center of gravity of a side container is positioned over its respective pivot axis the distance between the pulley and the respective attachment means where said cable attaches to the side container is as short as possible.

19. A container assembly as claimed in claim 9 wherein said pulleys and pivot axes and the centers of gravity of the side containers, respectively, are positioned with respect to each other so that when the center of gravity of a side container is positioned over its respective pivot axis the distance between the pulley and the respective attachment means where said cable attaches to the side container is as short as possible.

20. A container assembly as claimed in claim 10 wherein said pulleys and pivot axes and the centers of gravity of the side containers, respectively, are positioned with respect to each other so that when the center of gravity of a side container is positioned over its respective pivot axis the distance between the pulley and the respective attachment means where said cable attaches to the side container is as short as possible.

* * * * *